United States Patent [19]

Kudrus

[11] Patent Number: 5,076,509

[45] Date of Patent: Dec. 31, 1991

[54] THREAD TRAVERSING DEVICE

[75] Inventor: Heiner Kudrus, Padenstedt, Fed. Rep. of Germany

[73] Assignee: Neumag-Neumüunstersche Maschinen- und Anlagenbau GmbH, Neumünster, Fed. Rep. of Germany

[21] Appl. No.: 604,889

[22] Filed: Oct. 26, 1990

[30] Foreign Application Priority Data

Oct. 31, 1989 [DE] Fed. Rep. of Germany ... 8912875[U]

[51] Int. Cl.[5] ..... B65H 54/30

[52] U.S. Cl. ..... 242/43 A; 242/158 B

[58] Field of Search ..... 242/43 A, 43 R, 158 B

[56] References Cited

U.S. PATENT DOCUMENTS

| | | | |
|---|---|---|---|
| 3,333,782 | 8/1967 | Beckwith, Jr. | 242/43 A |
| 3,491,962 | 1/1970 | Roberts | 242/43 A |
| 4,674,695 | 6/1987 | Kamp et al. | 242/43 A |
| 4,767,072 | 8/1988 | Kamp et al. | 242/43 A |
| 4,901,932 | 2/1990 | Kamp et al. | 242/43 A |
| 4,921,181 | 5/1990 | Kamp | 242/43 A |

*Primary Examiner*—Stanley N. Gilreath
*Attorney, Agent, or Firm*—Michael J. Striker

[57] ABSTRACT

A thread traversing device for a winding unit comprises an endless belt provided with a plurality of drivers and having two runs which run in a traversing region approximately parallel to one another and in opposite directions and form outside the traversing region reverse loops, two pairs of guiding rollers provided for guiding the runs in the traversing region, at least two deviating rollers each provided at one side outside of the traversing region for guiding a respective one of the reverse loops. The guiding rollers of the both runs are arranged near one another so that side surfaces of the guiding rollers of one run face side surfaces of the guiding rollers of the other run. The deviating rollers are arranged skewed to the guiding rollers, and the belt in the region of the reverse loops being twisted to form a spatial belt drive.

6 Claims, 5 Drawing Sheets

THREAD TRAVERSING DEVICE

BACKGROUND OF THE INVENTION

The present invention relates to a thread traversing device for winding units.

For winding of threads with extremely high thread speeds, for example 6,000 m/min. thread traversing devices are known in which the thread is reciprocated by drivers mounted on two belt runs which move near one another in opposite directions. The alternating movement of the threads is therefore actuated not as in conventional thread traversing devices by a single reciprocating thread guide, but instead, the oppositely moving drivers alternatingly engage and guide the threads. Since the drivers on the reverse points of the threads are neither accelerated nor decelerated, the influence of the inertia mass of the thread guiding elements during the thread reverse is completely eliminated.

German reference DE-OS 1,535,091 shows a different belt thread traversing device. In several embodiments two endless belts running over two guiding rollers are arranged so that a run of one belt is guided at a short distance parallel to a run of the other belt. There are also examples in which the guiding rollers of one belt and the guiding rollers of the other belt are arranged on coaxial or parallel offset axes near one another. In other words, they are arranged so that the guiding rollers of one belt and the corresponding guiding rollers of the other belt face one another at a side surface. It has been shown in practice that in the two-belt systems, due to different expansion of both belts as a result of different material properties or different aging, sychronization problems often occur which can lead to an inaccurate formation of the end surfaces of the coil. The novelty of the present invention has nothing to do with such two-belt systems.

In another embodiment disclosed in this patent only a single running belt is provided. It forms one longer run between two outer guiding rollers and another shorter run of the traversing region between inner guiding rollers. All guiding rollers lie in one plane and in a row one behind the other when seen in the movement direction of one run. The outer guiding rollers are arranged at relatively great distance from one another. Each inner roller is arranged in the intermediate space between both outer driving rollers close to the same The inner guiding rollers guide the short run over a path which substantially corresponds to the axial distance of both inner guiding rollers and defines the maximum possible traversing stroke, in short distance parallel to the longer run moving in opposite direction. During transition from the outer guiding rollers to the associated inner guiding rollers the run of the belt is approximately S-shaped so that the belt abuts with its side surface against the outer guiding roller and with its another side surface against the inner guiding roller. The drivers are arranged on a small edge of the belt.

German document DE-OS 3,627,544 describes a belt traversing with a single belt guided over outer and inner guiding rollers. They are arranged similarly to the device described hereinabove. However, the belt is guided between outer guiding rollers and associated inner guiding rollers in form of a reverse loop over an additional deviating roller. All roller axes are parallel, so that the belt runs in one plane as described in the preceding device. This plane extends parallel to the traversing triangle.

A device disclosed in U.S. Pat. No. 3,333,782 differs from the above mentioned device by the fact that the axes of different rollers are slightly inclined relative to one another. As a result the both runs of the traversing region extend not exactly parallel, but intersect under a very acute angle. Thereby the transition of the thread is facilitated at the end of the traversing region. This arrangement however does not differ in that the arrangement is provided with four guiding rollers as considered in the movement direction of one of the runs, arranged substantially in a row one behind the other. The belt stands on edge with respect to the plane of the traversing triangle, and the drivers are arranged on a small edge of the belt. The belt abuts with its one side surface against the outer guiding roller and with its another side surface on the associated inner guiding roller.

In the above discussed belt traversing device in which both oppositely running runs belong to a single endless belt, the traversing stroke or in other words the coil length is evidently not greater than the path over which the both runs run parallel or approximately parallel near one another. This path is equal to the axial distance of both inner guiding rollers or in other words the shorter run defines the traversing stroke. This means in other words that the structural length of the belt traversing device or in other words the size in the traversing direction always exceed the spool length by at least three times the roller diameter. When several such systems are arranged for simultaneous binding of several spools located on one axle in a row near one another, the system-dependent distance between each two coils is always greater than the three-times roller diameter. The roller diameter cannot be selected arbitrarily small. The minimal permissible roller diameter depends on the type of the belt and is prescribed by the belt manufacturer. In the praxis, the belt traversing device which pertains to the prior art has considerably great structural length and respective coil distances as in traversing device which are for example provided with turn threaded shafts.

German reference DE-OS 3,739,850 deals with the above mentioned problem and discloses a traversing device in which two guiding rollers are arranged at both ends of the traversing region with parallel axes in a plane and are mirror symmetrical relative to one another. Therefore, both runs which pass the traversing region have the same length. Each of the rollers is associated in a laterally arranged deviating roller. The belt is guided over both deviating rollers in a loop-type manner, and the part of the belt connected with both deviating rollers is guided at a small distance before or after both guiding rollers. The total run of the belt lies in one plane, In this device the ratio of structural length to traversing stroke is substantially better than in other belt systems. It has however the disadvantage that it is very bulky in direction transverse, to the traversing movement in a plane parallel to the traversing triangle. Thereby its possibilities of utilization are limited and the main advantage cannot be materialized for structural reasons.

SUMMARY OF THE INVENTION

Accordingly, it is an object of the present invention to provide a thread traversing device which avoids the disadvantages of the prior art.

More particularly, it is an object of the invention to provide a thread traversing device with a favorable ratio of structural length to traversing stroke also in a transverse direction.

In keeping with these objects and with others which will become apparent hereinafter, one feature of the present invention resides, briefly stated, in a thread traversing device in which the guiding rollers of both runs are arranged near one another so that they face one another at one side surface, the deviating rollers are skewed to the guiding rollers, the belt in the region of the reverse loops is twisted similarly to a spatial belt transmission.

The belt lies on all rollers over which it is guided with the toothed inner side. At no location of its run a counter curving occurs. The drivers are arranged on the outer surface of the belt. The belt runs past the traversing region in a flat position, or in other words the outer surface is at least approximately parallel to the plane of the traversing region.

In accordance with another feature of the present invention, the distance between both runs is reduced by the inclined position of the axes of the guiding rollers. This construction provides for advantages since the lines over which the drivers move in the traversing region are arranged closely near one another.

An especially compact construction is achieved when in accordance with the present invention the belt surrounds the guiding rollers over an angular region of substantially 180°.

In accordance with a further feature of the present invention, the axes of both guiding rollers arranged near one another are offset in the direction in which the runs extend, and at least in the region of the guiding rollers a guiding arm is arranged between both runs. This construction is especially suitable for insuring an exact thread transfer in reverse points of the traversing region. The feature of the main idea of the invention in that the guiding rollers are arranged near one another does not exclude the offset specified hereinabove for example by a distance which substantially corresponds to the radius of the guiding rollers.

Still another feature of the present invention is that the drivers are formed as thin pins which project perpendicularly or approximately perpendicularly from the outer surface of the belt. Such construction has an advantage in that the drivers, as compared with another one belt systems with double-wedge-shaped drivers, practically do not cause local rigidification of the belt and have only a small mass. Thereby the running quietness is improved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
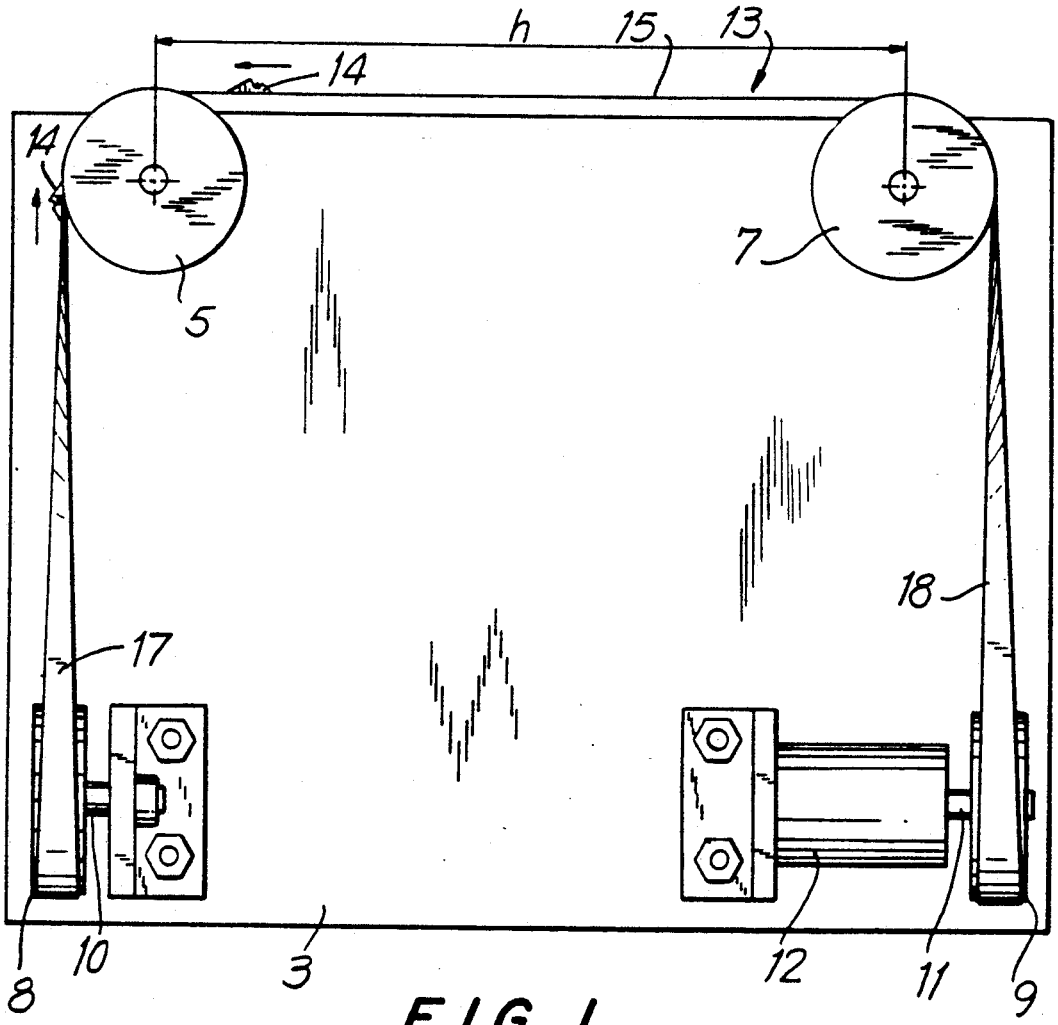
FIGS. 1-3 show front, plan and side views of one embodiment of a thread traversing device in accordance with the present invention in three perpendicular directions.
Figure 2:
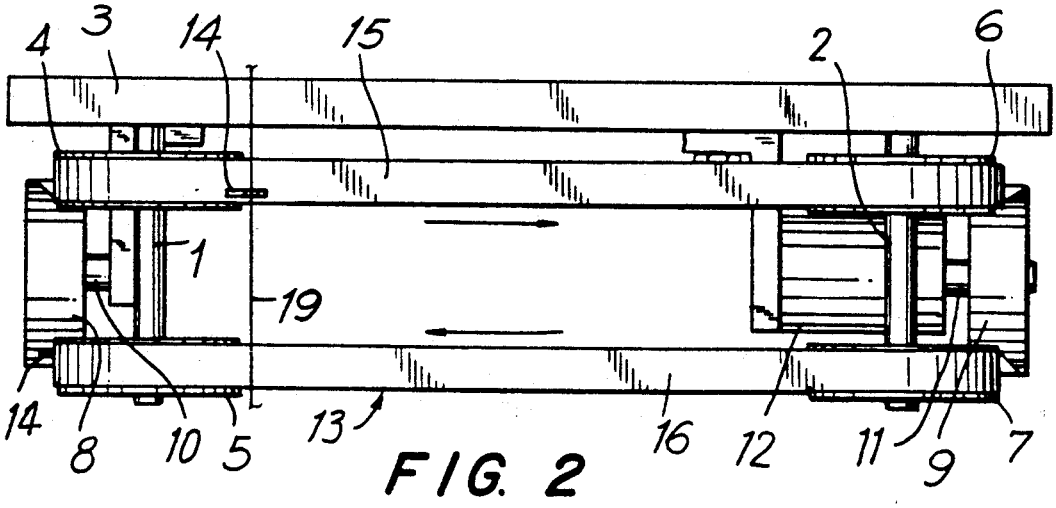
Figure 3:
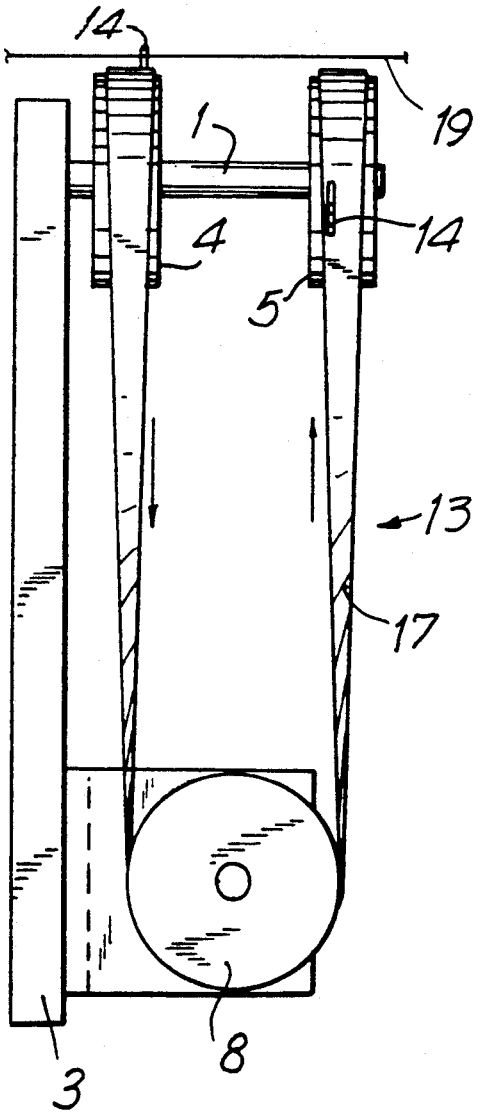

FIGS. 1-3 show a thread traversing device in accordance with the first embodiment of the invention and parts of the device are identified with corresponding reference numerals. In the embodiment shown in FIGS. 5-8 parts which corresponds to the parts of FIGS. 1-3 are identified with reference numerals which are higher than corresponding reference numerals of the first embodiment by 20. Analogously, in the thread traversing device shown in FIGS. 9-11, parts which correspond to the parts of the embodiment of FIGS. 1-3 are identified with reference numerals higher by 40 to the reference numerals of the embodiment of FIGS. 1-3. The parts shown in FIGS. 5-11 are described only when they deviate from corresponding parts of FIGS. 1-3.

Axles 1 and 2 are mounted near an upper edge of a base plate 3 at its opposite sides. Two guiding rollers 4, 5 and 6, 7 are rotatably supported on the axles 1 and 2 respectively. Two deviating rollers also provided at their periphery with teeth are arranged in the vicinity of the lower edge of the base plate 3. One deviating roller 8 is mounted freely rotatable on an axle 10. The other deviating roller 9 is seated on a shaft 11 on a drive motor 12. The axle 10 is skewed relative to the axle 1 so that the parallel projection of the axle 1 extending perpendicularly to the plane of the drawing of FIG. 2 intersects the axle 10 at a right angle as specifically shown in FIG. 2. The same is true with respect to axle 11 which carries the deviating roller 9 with respect to the axle 2.

Figure 4:
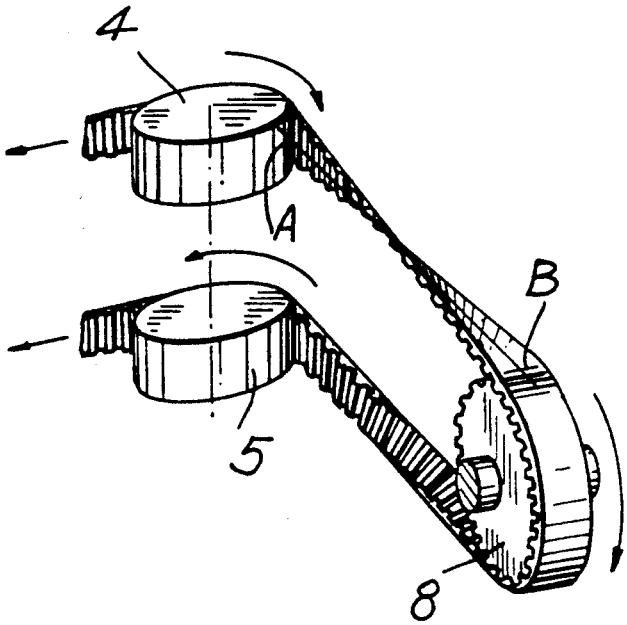
FIG. 4 is a perspective view of a detail and illustrates a spatial belt transmission.
Figure 5:
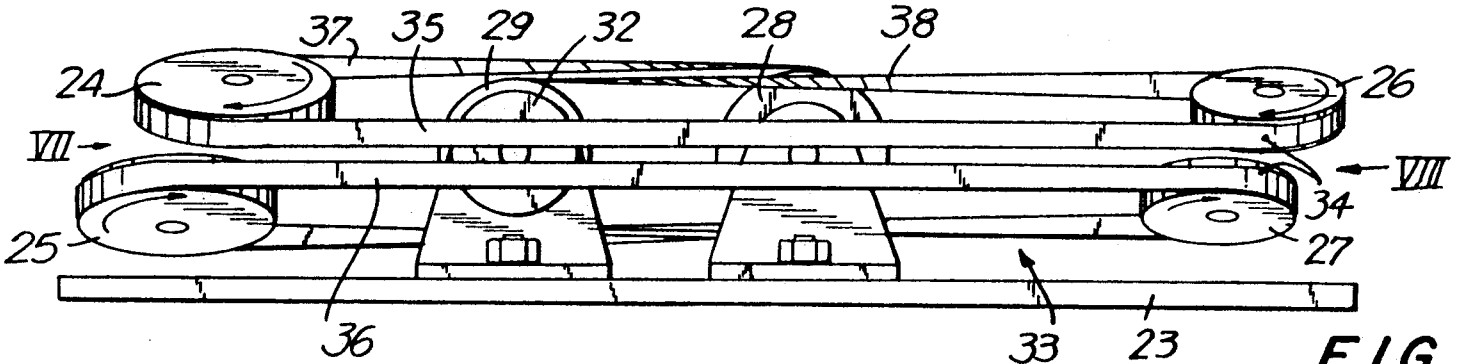
FIGS. 5 and 6 show front and plan views of another embodiment of the thread traversing device of the present invention with two views in perpendicular direction.
Figure 6:
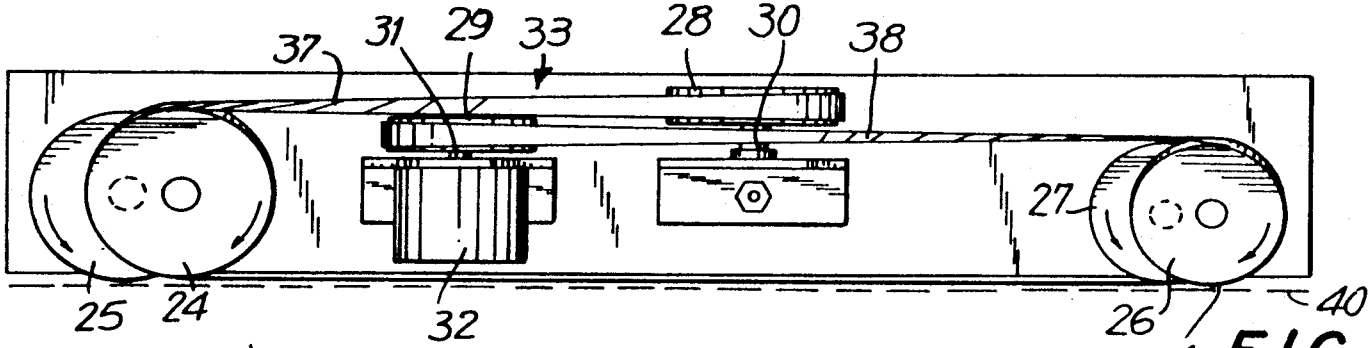

An endless toothed belt 13 is provided with a plurality of drivers 14 arranged at equal distances from one another. It is guided over the guiding rollers 4, 5, 6, 7 and the deviating rollers 8, 9. Two parallel runs 15 and 16 are located within both guiding roller pair 4, 5 on the one hand and 6, 7 on the other hand and move in opposite direction as identified with arrows in FIG. 2. The belt 13 surrounds each guiding rollers over an angular region of 90° and forms reverse loops 17, 18 so that it is guided as a spatial belt drive over the deviating rollers 8 and 9. Due to the skewed arrangement of the axes it is twisted in the region of the reverse loops. It abuts with its toothed inner surface on all guiding rollers and on both deviating rollers. As can be seen from FIG. 4 the guiding roller 4 and the deviating roller 8 are arranged relative to one another so that the straight line which connects both discharge points A and B is simultaneously the intersecting line of the both central roller planes. This condition is fulfilled for a spatial belt drive for two rollers between which a twisted belt portion extends, also when the relative angular position of the axles deviates from the position shown in FIGS. 1-4.

The region in which both runs 15 and 16 extend is a traversing region. The length identified with letter h, or in other words substantially the distance between the axles 1 and 2 is the traversing stroke. The plane in which a supplied thread 19 reciprocates during the operation, or in other words the plane of the traversing triangle extends in FIG. 1 and in FIG. 3 perpendicular to the plane of the drawing, and in FIG. 2 parallel to the plane of the drawing. The runs 15 and 16 pass the traversing region, with reference to the plane of the traversing triangle, in a flat position, and the drivers sit on the outer surface.

In deviating from the above described embodiment in which the distance between both runs 15 and 16 is determined by the diameter of the deviating rollers 8 and 9, runs 35 and 36 in the embodiment shown in FIGS. 5–8 are located substantially closer to one another. The reduction of the distance which is important for exact thread transfer is possible here because guiding rollers 24 and 26 of one run 35 and the guiding rollers 25, 27 of the other run 36 lie in planes which are inclined relative to one another. Therefore, the intermediate space between the guiding rollers 24, 25 and 26, 27 is reduced in a wedge-shaped manner in direction to the side, on which the discharge points of the runs 35, 36 lie. This is especially clearly shown in FIG. 7 and FIG. 8. Each guiding roller 24, 25, 26, 27 is supported on a corresponding axle. The axes of the guiding roller pairs 24, 25 and 26, 27 are inclined and intersect in the projection shown in FIG. 7 and FIG. 8 under an obtuse angle. Moreover, the axes of both guiding rollers 24, 25 and the axes of both guiding rollers 26, 27 are offset relative to one another in the direction in which the runs 35, 36 extend by a distance which substantially corresponds to the radius of a guiding roller. For facilitating the observation the axles and the holding elements of the guiding rollers 24, 25, 26, 27 are not shown in FIGS. 5–8. They can be formed for example similarly to the embodiment of FIGS. 9–11 and mounted on a base plate 23. Despite the changed position of the axes relative to one another, it is also true for this embodiment and similarly to the embodiment of FIGS. 1–4, that the guiding rollers 24, 25 and the guiding rollers 26, 27 are arranged near one another and face a side surface.

Figure 8:
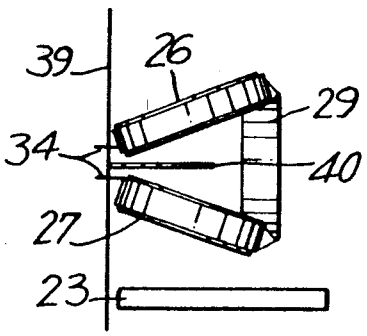
FIGS. 7 and 8 are schematic views as seen in the direction of arrows VII or VIII in FIG. 5.
Figure 7:
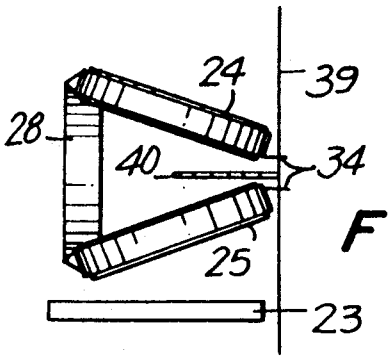

The toothed belt 33 surrounds the guiding rollers 24, 25, 26, 27 over an angular region of 180°. Drivers 34 are formed as thin pins and extend inclined from the outer surface of the belt 33 so that they are oriented perpendicularly to the traversing triangle during passage through the traversing region as shown in FIGS. 7 and 8. The geometrical axes of the deviating rollers 28, 29 are arranged perpendicularly to the direction in which the runs 35 and 36 extend and coincide in the embodiment of FIG. 7 and FIG. 8 with the angle bisectrixes of the obtuse angle enclosed by the axes of the guiding rollers 24, 25, and 26, 27. The reverse loops 37, 38 intersect one another so that the deviating roller 28 which belongs to the reverse loop 37 of the guiding roller pair 24, 25 is located closer to the other guiding roller pair 26, 27 than the deviating roller 29 belonging to its reverse loop 38. For this reason the guiding rollers 26, 27 have a substantially smaller diameter than the guiding rollers 24, 25 so that both deviating loops 37, 38 lie in separate planes. These both planes extend parallel to the plane in which both runs 35, 36 are running. The deviating roller 29 is seated on the shaft 31 of a drive motor 32.

Figure 9:
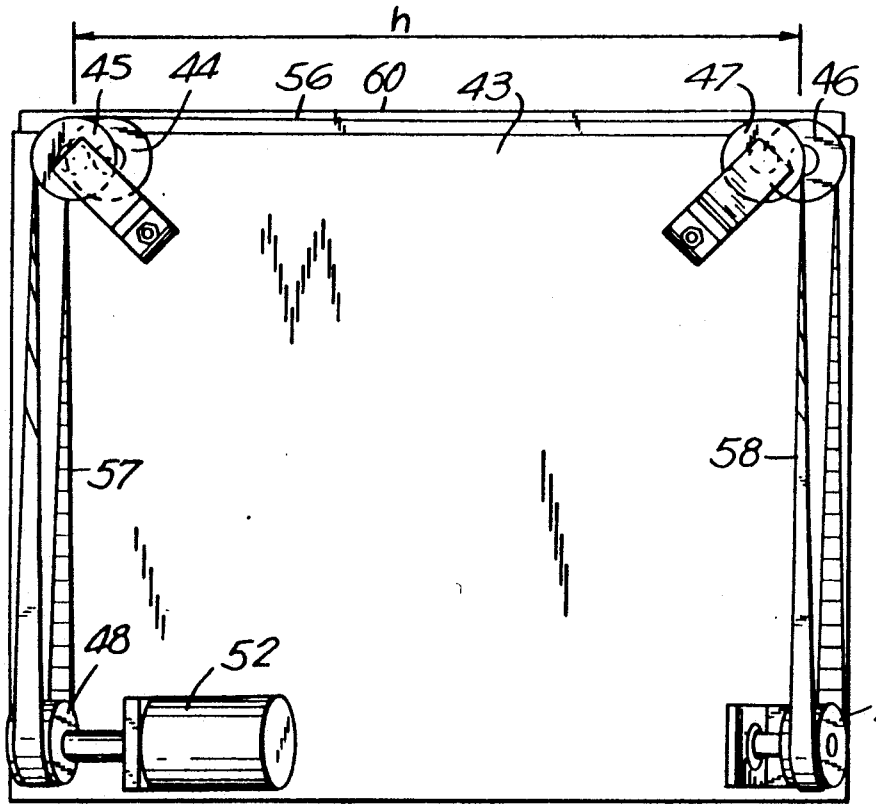
FIGS. 9-11 are front, plan and side views showing a further embodiment of the thread traversing device in accordance with the present invention in three perpendicular directions.
Figure 11:
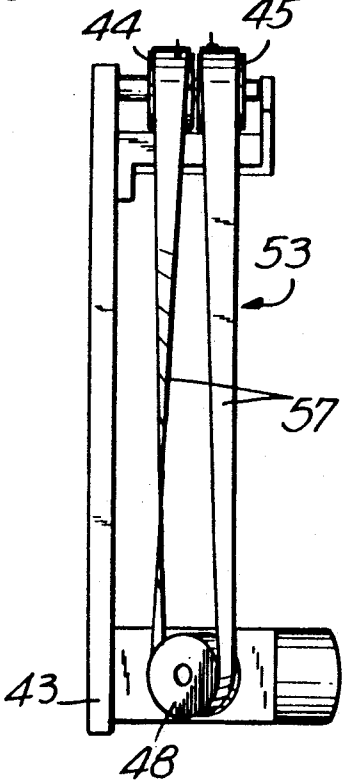
Figure 10:
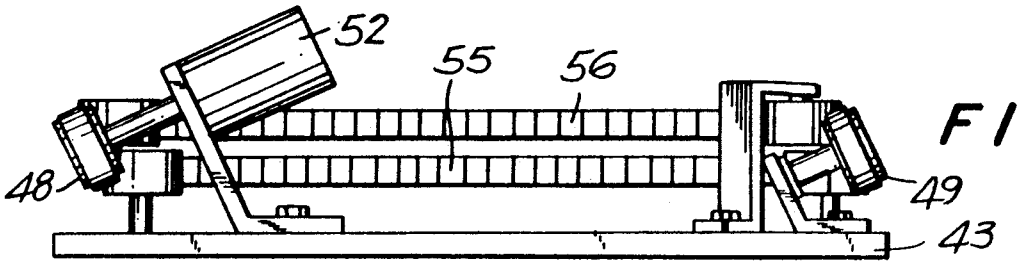

The embodiment of FIGS. 9–11 corresponds to the embodiment of FIGS. 5–8 in that the axes of both guiding roller pairs 44, 45 and 46, 47 are offset relative to one another in the direction in which the runs 55 and 56 extend and are inclined as can be seen from FIG. 11. However, the inclined position is significantly smaller than in the previous embodiment. This is caused by an arrangement of the deviating rollers 48, 49 which substantially corresponds to the arrangement of the embodiment of FIGS. 1–3 with the difference that the geometrical axes of the deviating rollers 48, 49 and the drive motor 52 are inclined in correspondence with the offset arrangement of the guiding roller pairs 44, 45 and 46, 47. The central plane of the deviating roller 48 intersects the central plane of both guiding rollers 44, 45 in both lines which are shown in dash-dot lines in FIG. 11 and represent the connecting straight lines of both side discharge points. The same is true for the position of the deviating roller 49 relative to the guiding rollers 46, 47. Due to the inclined position of the deviating rollers 48, 49 the reverse loops 57, 58 are asymmetrical. FIG. 11 shows that the part which extends from the guiding roller 44 to the deviating roller 48 is more strongly twisted than the other part. The guiding rollers 44, 45, 46, 47 and the deviating rollers 48, 49 have all the same diameter.

Figure 12:
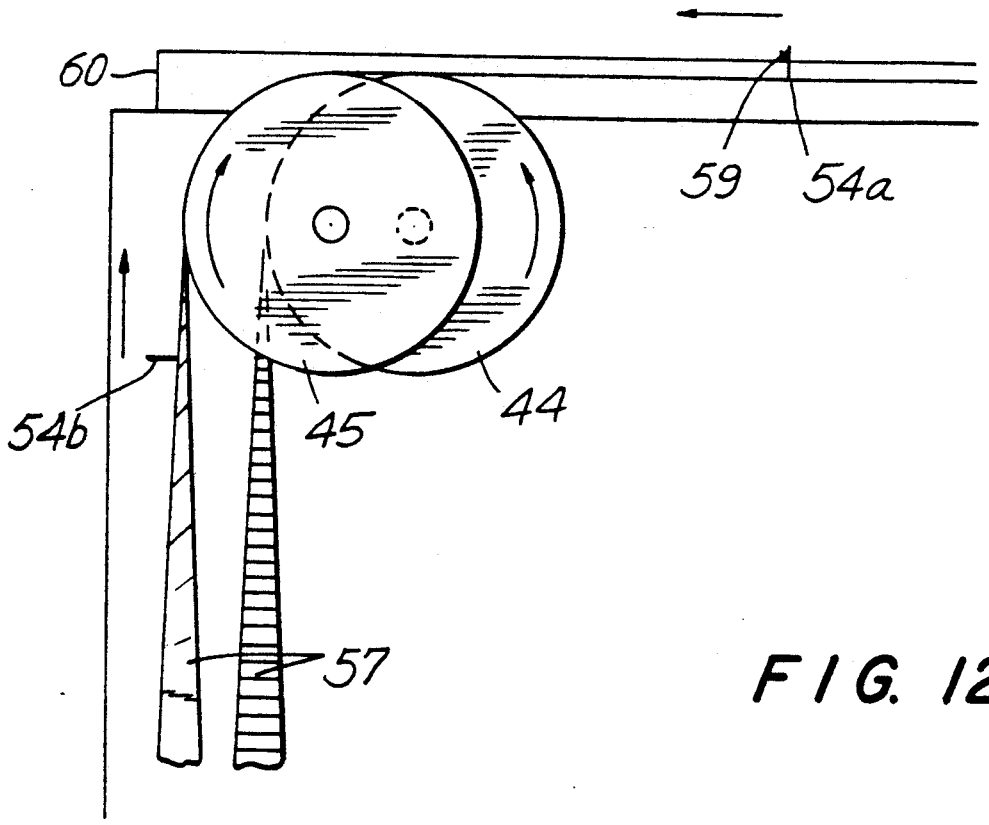
FIGS. 12 and 13 show a detail of FIG. 9 in form of a moment representation of the two different operational phases, on an enlarged scale.
Figure 13:
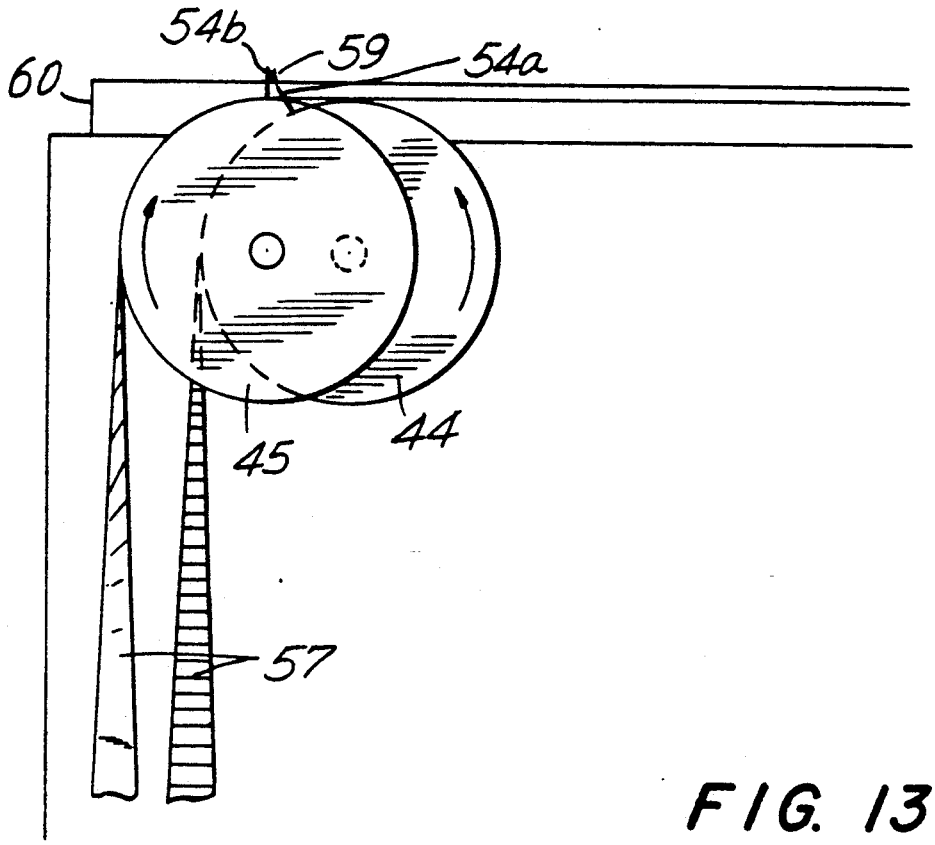

FIGS. 12 and 13 serve for illustrating the thread transfer at the end of the traversing region. In FIG. 12 a driver **54*a* which projects perpendicularly from the outer surface of the belt 53 and extends over the thread guiding arm 60 moves a thread 59 along the thread guiding arm 60 to the left. When the driver 54*a* reaches the guiding roller 44, it moves further on the guiding roller over a curved path. It dips under the edge of the thread guiding arm 60 and leaves the contact with a thread 59. In this moment which is shown in FIG. 13 the oppositely moving other driver 54*b* due to the offset arrangement of the guiding rollers 44, 45 reaches the position in which it extends outwardly over the edge of the thread guiding arm 60. It takes over momentarily the thread 59 and displaces it in an opposite direction, or in other words to the right in FIG. 13**. Arrangements which can perform similarly advantageous and exact operations are known in two belt systems. However, they are not transferable to known one-belt systems since in these systems the belt runs in one plane, in which it stands on edge with the respective plane of the traversing triangle and the driver sits on its smaller edge.

It will be understood that each of the elements described above, or two or more together, may also find a useful application in other types of constructions differing from the types described above.

While the invention has been illustrated and described as embodied in a traversing device for a winding unit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A thread traversing device for a winding unit, comprising an endless belt provided with a plurality of drivers and having two runs which run in a traversing region approximately parallel to one another and in opposite directions and form outside the traversing region reverse loops; two pairs of guiding rollers provided for guiding said runs in said traversing region; at least two deviating rollers each provided at one side outside of said traversing region for guiding a respective one of said reverse loops, said guiding rollers of said both runs being arranged near one another so that side surfaces of the guiding rollers of one run face side surfaces of the guiding rollers of the other run, said deviating rollers being arranged skewed to said guiding rollers, and said belt in the region of said reverse loops being twisted to form a spatial belt drive.

2. A device as defined in claim 1, wherein said guiding rollers of each run have axes which are inclined relative to said guiding rollers of the other run so as to reduce a distance between said runs.

3. A device as defined in claim 1, wherein said belt surrounds said guiding rollers over an angular region of substantially 180°.

4. A device as defined in claim 1, wherein said runs extend in a predetermined direction, said guiding rollers are arranged so that axes of two of said guiding rollers located near one another are offset in said direction in which said runs extend; and further comprising a thread guiding arm arranged between said runs at least in a region of said guiding rollers for engaging and guiding said thread.

5. A device as defined in claim 1, wherein said drivers are formed as thin pins extending perpendicularly from an outer surface of said belt.

6. A device as defined in claim 1, wherein said drivers are formed as thin pins extending approximately perpendicularly from an outer surface of said belt.

* * * * *